US007483339B2

(12) United States Patent
Deangelis et al.

(10) Patent No.: US 7,483,339 B2
(45) Date of Patent: Jan. 27, 2009

(54) ACOUSTIC PROJECTOR AND METHOD OF MANUFACTURE

(75) Inventors: Matthew M. Deangelis, Bedford, NH (US); Jason W. Osborn, Amherst, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 10/542,994

(22) PCT Filed: Oct. 12, 2004

(86) PCT No.: PCT/US2004/033627

§ 371 (c)(1),
(2), (4) Date: Jul. 20, 2005

(87) PCT Pub. No.: WO2005/062666

PCT Pub. Date: Jul. 7, 2005

(65) Prior Publication Data

US 2006/0056275 A1 Mar. 16, 2006

Related U.S. Application Data

(60) Provisional application No. 60/529,445, filed on Dec. 12, 2003.

(51) Int. Cl.
*H04R 17/00* (2006.01)
*G10K 11/00* (2006.01)

(52) U.S. Cl. ..... 367/159; 367/153; 367/165; 367/169; 367/173; 310/331; 310/334

(58) Field of Classification Search ..... 367/141, 367/153, 154, 159, 165, 173, 169; 310/337, 310/331, 334

See application file for complete search history.

(56) References Cited

U.S. PATENT DOCUMENTS

| | | | | |
|---|---|---|---|---|
| 4,220,887 | A | 9/1980 | Kompanek | |
| 4,651,044 | A | 3/1987 | Kompanek | |
| 4,821,244 | A | 4/1989 | Wood | |
| 5,020,035 | A | 5/1991 | Kompanek | |
| 5,122,992 | A | 6/1992 | Kompanek | |
| 5,126,979 | A | 6/1992 | Rowe, Jr. et al. | |
| 5,220,538 | A * | 6/1993 | Flanagan et al. | 367/157 |
| 5,229,978 | A * | 7/1993 | Flanagan et al. | 367/157 |
| 5,239,518 | A * | 8/1993 | Kazmar | 367/157 |
| 5,508,976 | A * | 4/1996 | Pauer | 310/337 |
| 5,592,359 | A | 1/1997 | Kompanek | |
| 5,805,529 | A | 9/1998 | Purcell | |
| 5,926,439 | A | 7/1999 | Piquette | |
| 5,949,741 | A | 9/1999 | Piquette | |
| RE37,204 | E | 6/2001 | Kompanek | |
| 6,491,095 | B2 | 12/2002 | Kompanek | |

(Continued)

*Primary Examiner*—Ian J Lobo
(74) *Attorney, Agent, or Firm*—Sand & Sebolt; Michael Sand; Daniel J. Long

(57) ABSTRACT

An underwater acoustic projector comprising one or more cylindrical shell segments (8), each shell segment (8) having an even number of drivers (10) mounted therein, and the method of manufacturing said projector. The shell segments (8) preferably are formed with a longitudinal slot (14) and have arcuate segments (16), preferably of a dielectric material extending along the sides of the slot (14) for retaining the drivers (10) within the shell segments (8). The combined lengths of the driver is between 70% and 90% of the shell segment (8) length.

8 Claims, 5 Drawing Sheets

U.S. PATENT DOCUMENTS 6,496,448 B1 12/2002 Kompanek
6,535,459 B1 3/2003 Hutton et al.
6,545,949 B1 4/2003 Franklin
6,567,342 B1 5/2003 Purcell et al.
6,567,343 B1 5/2003 Purcell et al.
6,584,039 B1 6/2003 Purcell et al.
6,643,222 B2 11/2003 Osborn et al.
6,649,069 B2 11/2003 DeAngelis
6,956,792 B1 * 10/2005 Osborn et al. ..... 367/174

* cited by examiner

ACOUSTIC PROJECTOR AND METHOD OF MANUFACTURE

CROSS REFERENCE TO RELATED APPLICATION

This application claims the benefit of U.S. provisional application Ser. No. 60/529,445, filed Dec. 12, 2003.

BACKGROUND OF THE INVENTION

1. Field of the Invention

The present invention relates to underwater acoustics and more particularly to underwater acoustic projectors and to the method of manufacturing the same. More particularly, the invention relates to an acoustic projector formed of one or more shell segments wherein each shell segment has an even number of drivers.

2. Brief Description of Prior Developments

In low frequency underwater acoustic projectors, a segmented assembly is used to ease piece part manufacturability, assembly and handling procedures. However this assembly procedure can result in acoustic segment interactions due to a longitudinal vibration mode and/or interaction due to water loading differences along the length of the projector. Segment interactions can disrupt and distort the acoustic transmissions, and can result in significant mechanical damage to the projector assembly.

The length of the driver and shell segment were usually limited by the length of the drive material that could be manufactured at a reasonable cost. This projector and method of construction is more susceptible to segment interactions when there are many shell segments, (3 or more). Such factors also limit flexibility in determining the number of segments per a given projector length. Thus, there is a need for an improved projector construction and method of manufacture which reduces assembly labor costs and reduces the number of parts for each projector, which reduces or eliminates dynamic loading on the projector and shell sheer stress for a given design, thereby increasing the depth capability and dynamic range of the projector.

SUMMARY OF INVENTION

Some examples of slotted shell prior art acoustic projectors are shown in U.S. Pat. Nos. 5,020,035; 5,122,992; 5,592,359; 6,491,095; and 4,220,887. Some examples of non-slotted acoustic projectors are shown in U.S. Pat. Nos. 5,926,439; 6,535,459; 6,545,949; and 6,567,343.

To solve this problem the acoustic projector of the present invention can be assembled in a "super segment" method with multiple drivers as part of a shell segment. This not only stiffens the longitudinal assembly but also reduces the number of segments for interactions to occur. The goal is to reduce the number of segments to 2 segments. If this is not possible then an even number of segments is needed. This solution solves interactions in the slotted cylinder projector, however this technique can be used in other transducer technologies.

The most significant advantage to the new constructions method is, multiple drivers in one shell segment which stiffens the shell segments in the longitudinal length direction and reduces longitudinal vibrations modes as well as significantly reduces acoustic segment interactions, usually caused by hydrodynamic load variations along the length. The new method and acoustic projector construction is also not constrained by the manufacturable length of the drive material.

The shell segment can be any length and multiple drivers can be assembled inside one shell segment. Additionally, this method is more cost effective and faster to assemble due to the reduced number of parts and pieces that need to be purchased or handled. Also the designer can use this construction method to ensure that the projector is designed with one or two shell segments, which is the optimum segment number(s) to eliminate segment interactions. If one or two segments can't be used then the designer has the flexibility to ensure an even number of shell segments can be used and any interactions can be managed via wiring, tuning, or shading methods.

BRIEF DESCRIPTION OF THE DRAWINGS

The present invention is further described with reference to the accompanying drawings wherein.

DETAILED DESCRIPTION OF THE PREFERRED EMBODIMENT

The most significant advantage to the new projector construction and method of the present invention is the use of multiple drivers in one shell segment which stiffens the shell segments in the length direction and reduces longitudinal vibration modes as well as significantly reduces acoustic segment interactions, usually caused by hydrodynamic load variations along the length. The new projector construction and method also is not constrained by the manufacturable length of the drive material. The shell segment can be any length and multiple drivers can be assembled inside one shell segment. Additionally, this projector construction and method is more cost effective and faster to assemble due to the reduced number of parts and pieces that need to be purchased or handled. Also the designer can use this construction and method to ensure that the projector is designed with one or two shell segments, which is the optimum segment number(s) to eliminate segment interactions. If one or two segments can't be used then the designer has the flexibility to ensure an even number of shell segments can be used and any interactions can be managed via wiring, tuning, or shading methods.

The single shell of the multiple driver shell segment forces the drivers to move more closely in unison than if the segments were one shell per driver. Another prior art was to bond, pin, or epoxy single drive/shell segments as to approximate the large single shell with multiple drivers. This construction and method has been used but has several inherent flaws. The epoxy/pinning mechanisms used are never as strong as a single shell. Combined with the tremendous forces that are exerted during drive and interaction, failure is almost assured.

However, the single shell multiple drivers reduces the interaction, and thus reduces the shear forces. Also, the single shell is significantly strong in the shear direction to handle any interaction forces that might occur. With the reduction of the segment interaction and longitudinal vibration modes, the acoustic projector produces a significantly larger dynamic range. The virtually eliminated segment interaction and longitudinal vibrations also reduces the dynamic stress on the projector and thus allows the projector to operate at a deeper depth.

Figures 1, 2:
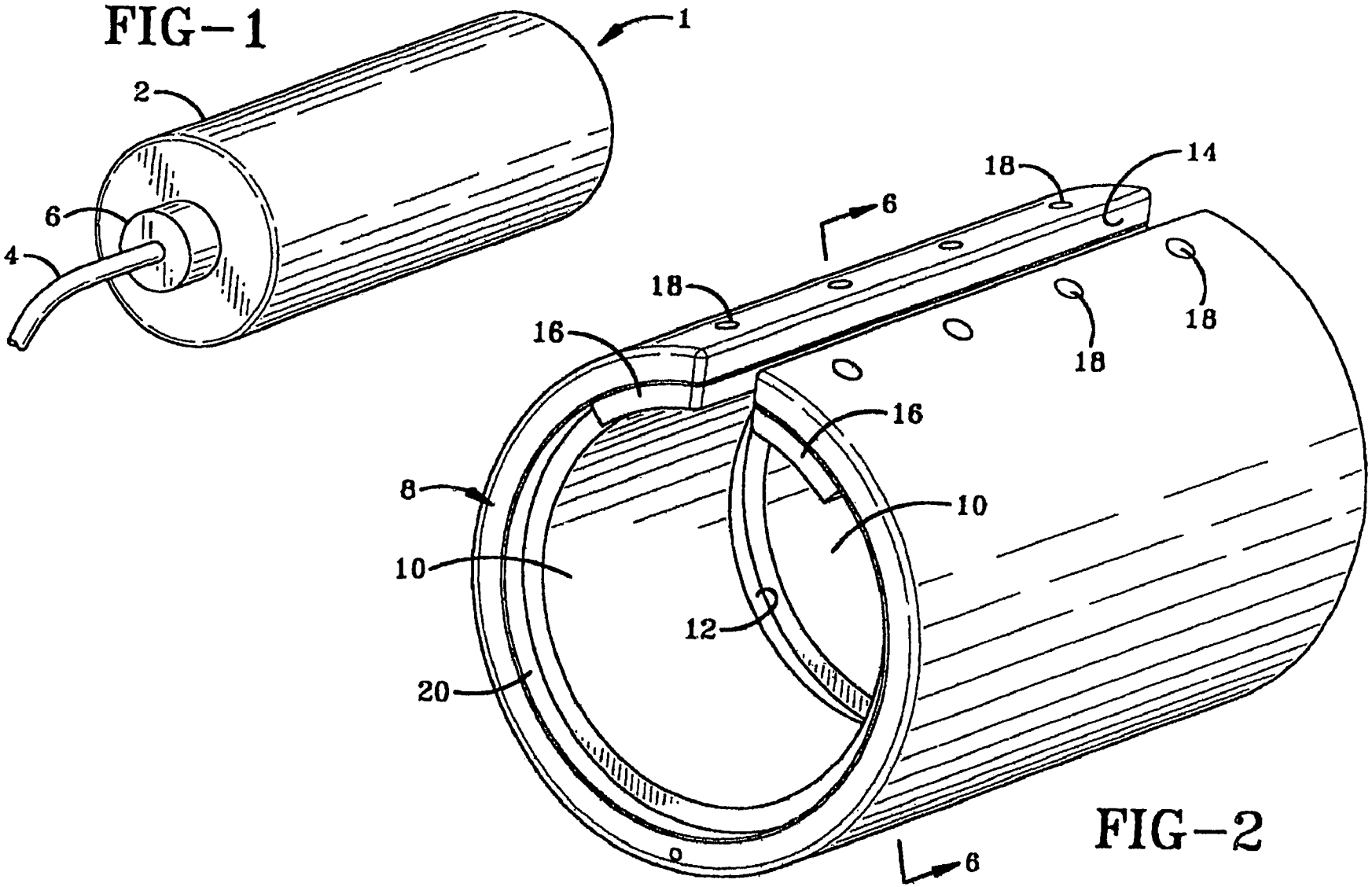
FIG. 1 is a perspective view of a completed acoustic projector in accordance with the invention.
FIG. 2 is a perspective view of a single multi-driver shell segment used in a preferred embodiment of the present invention.
Figure 3:
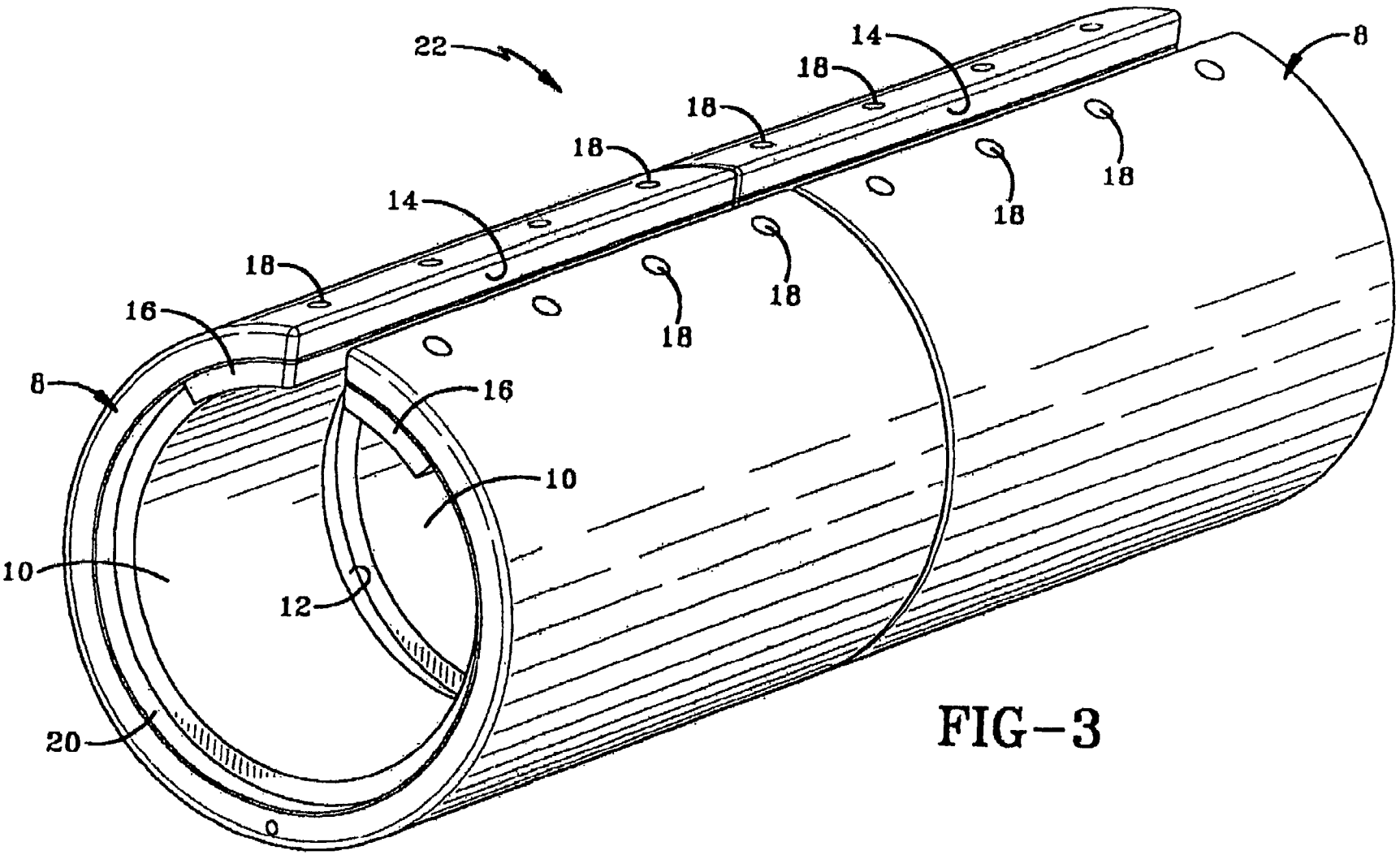
FIG. 3 is a perspective view of two multi-driver shell segments used in a preferred embodiment of the present invention.

The acoustic projector of the present invention is indicated generally at 1, and a first embodiment is shown in FIG. 1 with the unique features of the present invention being shown particularly in the embodiments of FIGS. 2 and 3. FIG. 1 shows an assembled acoustic projector having the assembled shell segments and drivers encased in an outer layer of a rubberized material 2 or other material resistant to the harsh undersea environment in which it will be utilized. The electrical cables 4 for supplying power to the enclosed drivers are secured by a connection 6. The electrical power is connected to the drivers contained therein in a usual manner well known in the acoustic projector art. It is readily understood that projector 1, in addition to the unique shell segments described below, will have a pair of end plates (not shown) connected together in the final projector assembly.

In accordance with the invention as shown in FIG. 2, a single shell segment 8 contains two transducers or drivers 10 which are separated by a gap 12. Drivers 10 are well known in the acoustic projector art, preferably formed of a piezoelectric material, and are connected to electrical cable 4, and thus are not described in further detail. Shell segment 8, preferably is formed with a longitudinally extending slot 14 along which extends a pair of arcuate segments 16 which are secured in position along slot 14 within the interior of shell segment 8, by a plurality of screws 18 or other type fasteners. Segments 16 will usually be formed of a dielectric material so as not to interfere with drivers 10, but could be formed of an electrically conductive material and separated from drivers 10 by a layer of insulation, if desired, without affecting the concept of the invention. Arcuate segments 16 assists in retaining drivers 10 within shell segment 8. Various types of a bonding adhesive or caulking material can also be used to secure drivers 10 within shell segment 8.

Preferably, the combined longitudinal lengths of drivers 10 will be between 70% and 90% of the longitudinal length of shell segment 8. This has been found to provide the most satisfactory results, both from the acoustic properties, as well as the strength of the assembled projector. A thin layer of insulation 20, preferably will be located between shell 8 and driver 10 to ensure the electrical integrity of the drivers even though outer shell 8 preferably will be formed of a dielectric material such as an epoxy graphite composition, fiberglass, a ceramic, or the like. However, shell 8 can be formed of various types of conductive materials, such as metal and separated from drivers 10 by an insulation layer 20.

However, in accordance with the invention, at least two drivers 10 are mounted within a single shell segment 8, or for certain applications, an even number of drivers, for example, 4, 6, or 8, etc. could be mounted within a single shell segment. This reduces the sheer stress and dynamic loading on the shell thereby increasing the depth capability and dynamic range of projector 1.

Figure 4:
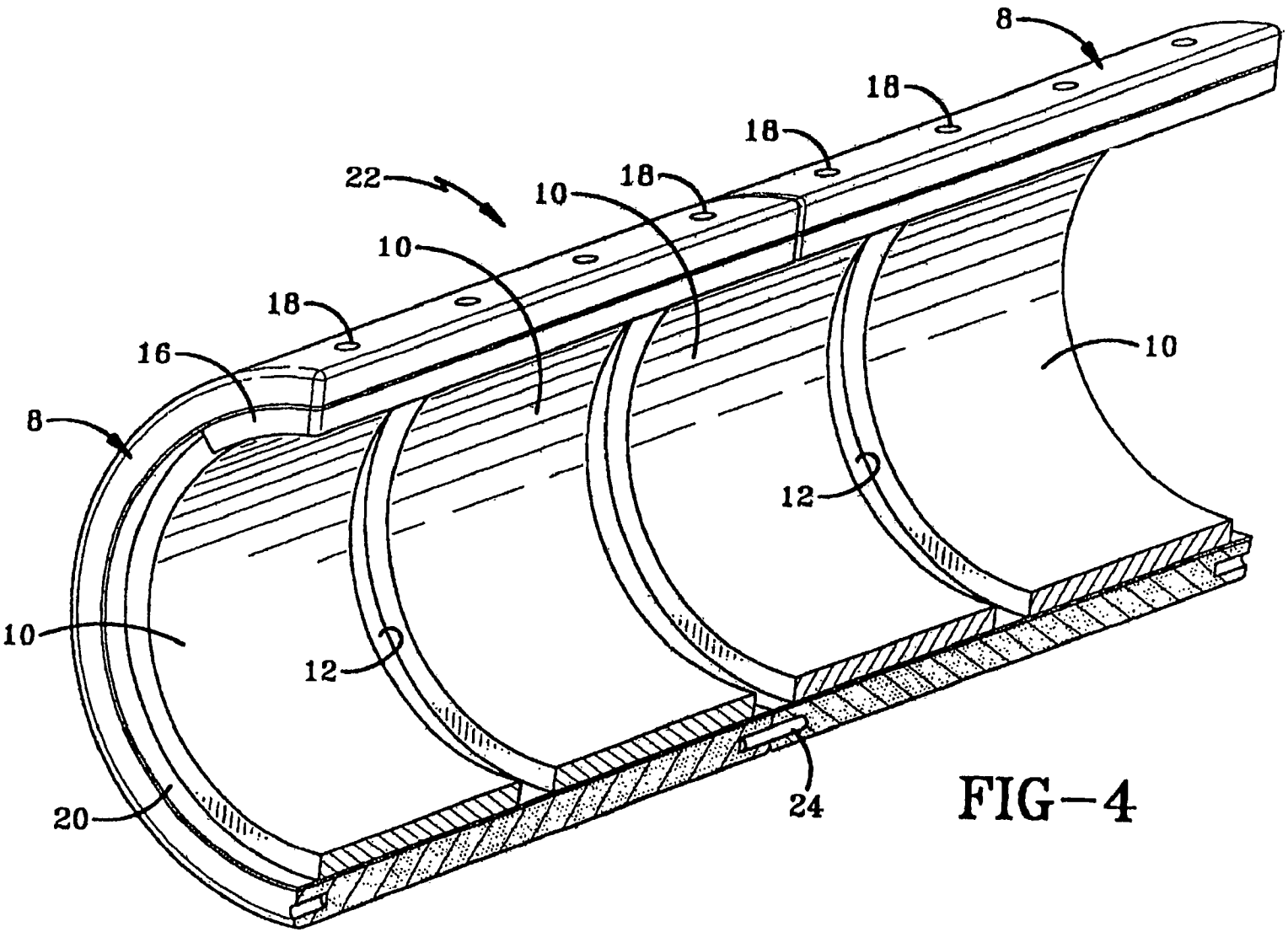
FIG. 4 is a longitudinal cross sectional view of the assembled multi-driver shell segments shown in FIGS. 1 and 2.

A modified form or extension of the present invention is indicated generally at 22, and shown in FIG. 3. Embodiment 22 consists of a pair of shell segments 8, and as discussed above, each segment 8 containing a pair of drivers 10, which segments are joined together to provide a multiple shell segment, each containing multiple drivers. The remaining construction of projector 22 is similar to that described with respect to shell 8 and driver 10. The shell segments preferably are longitudinally joined by a lower alignment pin 24 (FIG. 4) with various types of epoxies or glues at their mating edges.

It is also understood that other multiple shell segments can be joined longitudinally, each containing multiple drivers, for example, four shell segments could be joined, six shell segments, etc. It is preferable that the number of shell segments be even multiples of two, and as discussed above, the number of drivers being multiples of two in each of the shell segments. This arrangement reduces interaction among the shell, reduces shell sheer stress, and enables various acoustic results to be achieved thereby.

Figure 7:
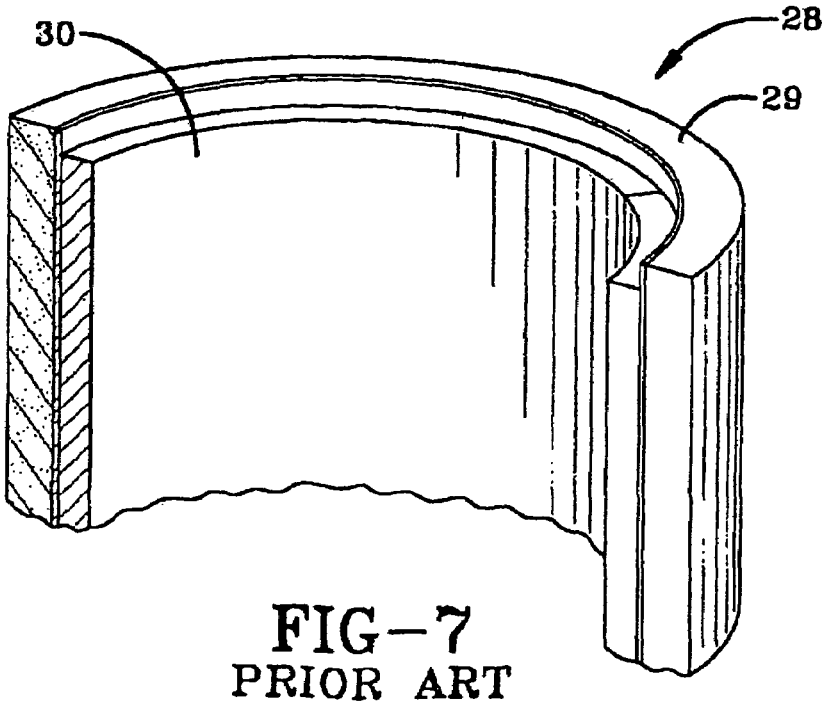
FIG-7 PRIOR ART
FIG. 7 is a perspective view of the prior art of one driver with one shell segment.

FIG. 7 shows a prior art shell/driver assembly indicated at 28, which consists of one shell segment 29 containing one driver 30 therein. As discussed previously, the length of single shell, single driver constructions had shortcomings in that excessively long shells necessary to achieve the desired acoustic transmissions are subject to vibration modes and water loading effects along the length of the shell.

Figure 5:
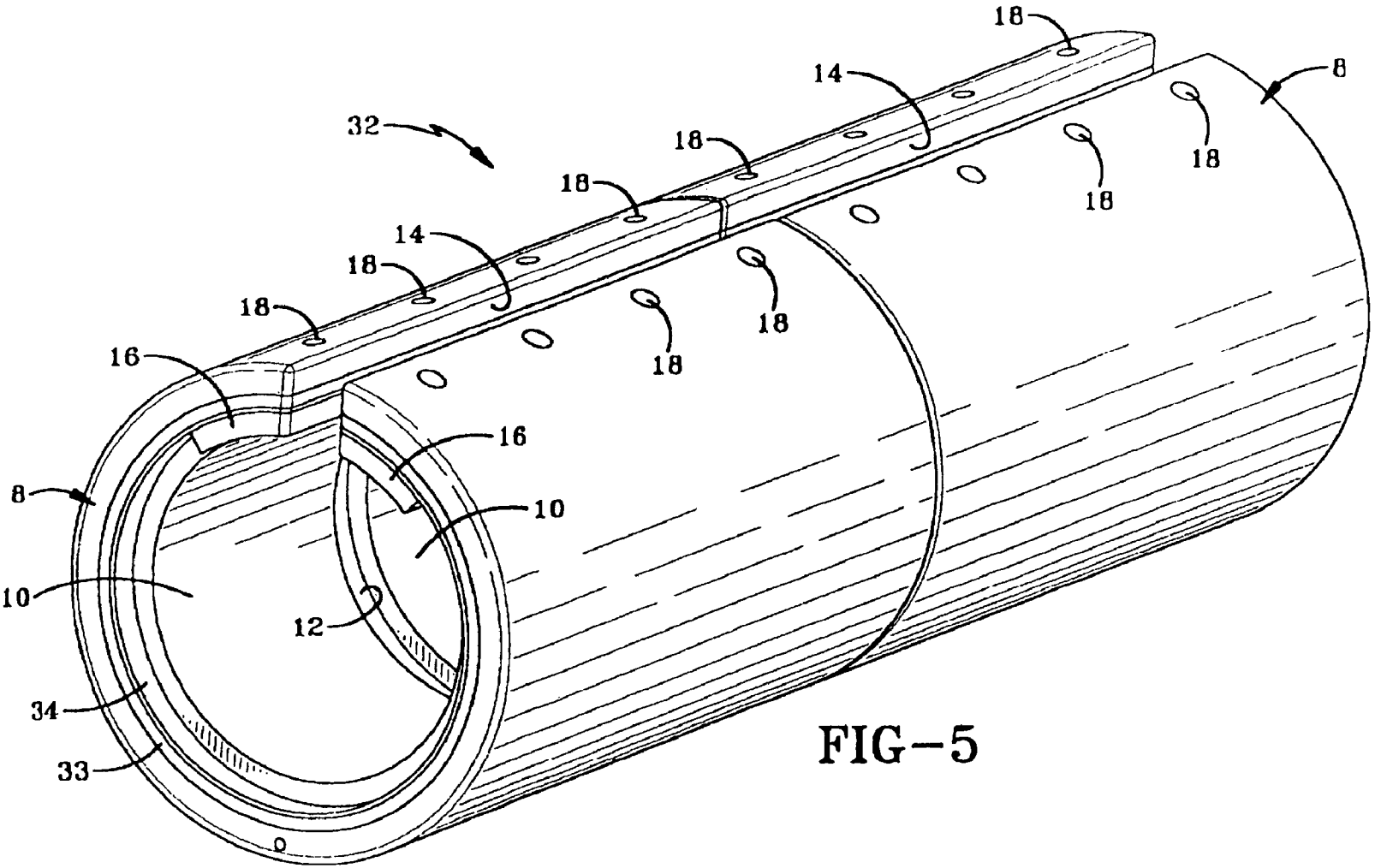
FIG. 5 is a modified embodiment of the shell segment shown in FIG. 3 with a reinforcing metal liner.
Figure 6:
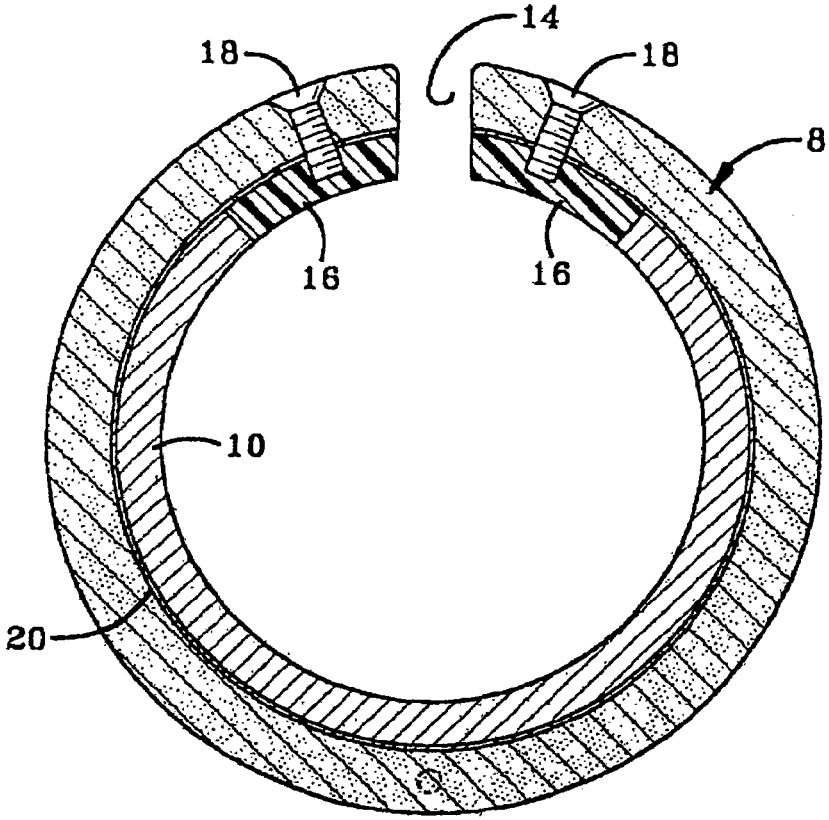
FIG. 6 is a cross-sectional view taken on line 6-6, FIG. 2.

A modified embodiment of the improved projector is shown in FIG. 5, and is indicated generally at 32. Projector 32 is similar to embodiment 22 shown in FIG. 3 with the exception that it contains a metal liner 33 which extends throughout the axial length of each shell segment and is located between outer shell segment 8 and drivers 10 and separated from the drivers 10 by an insulating layer 34.

In summary, the present invention provides an improved acoustic projector construction consisting of at least one shell or preferably even multiples thereof, with each shell segment containing two or more even number of drivers therein. Preferably, the shell segments will be slotted and the combined length of the drivers in each shell segment will be between 70% and 90% of the length of the shell segment, which determines the spacing between the drivers and distance inwardly from the end plates of the assembled acoustic projector. This arrangement enables shell interaction to be controlled or managed, reduces assembly labor and thus costs because of less parts, reduces dynamic load on the projector and thus increases depth capability and dynamic range, and reduces shell shear stress for a given shell/driver design.

While the present invention has been described in connection with the preferred embodiments of the various figures, it is to be understood that other similar embodiments may be used or modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. An acoustic projector comprising a single cylindrical shell segment and only two longitudinally spaced drivers mounted within said shell segment and wherein the shell segment is formed with a longitudinal slot; and wherein arcuate segments of material are mounted within the interior of the shell segment and extend along opposite sides of the slot.

2. The acoustic projector defined in claim 1 wherein the shell segment is formed of an epoxy graphite material.

3. The acoustic projector defined in claim 1 wherein the combined longitudinal length of the two drivers in the shell segment is between 70% and 90% of the longitudinal length of the shell segment.

4. The acoustic projector defined in claim 1 wherein two shell segments are longitudinally joined with each of the shell segments containing two longitudinally spaced drivers.

5. An acoustic projector comprising an even number of longitudinally-joined cylindrical shell segments, each of the shell segments being formed with a longitudinal slot; an even number of spaced drivers mounted within each of said shell segments, each of the drivers being in a longitudinal spaced relationship from the adjacent driver; and arcuate segments of material mounted within the interior of the shell segments and extending along opposite sides of the slots.

6. The acoustic projector defined in claim 5 when the arcuate segments are formed of a dielectric material.

7. The acoustic projector defined in claim 5 wherein the drivers are arcuate shaped members and are retained in their respective shell segment by the arcuate shaped segments.

8. The acoustic projector defined in claim 5 including a metal liner extending longitudinal along and mounted between the interior of the shell segments and the spaced drivers and electrically insulated from the drivers to provide structural reinforcement to the projector.

* * * * *